US010166429B2

(12) United States Patent
Chen

(10) Patent No.: US 10,166,429 B2
(45) Date of Patent: Jan. 1, 2019

(54) ADJUSTABLE KETTLEBELL DEVICE

(71) Applicant: Paul Chen, Vancouver (CA)

(72) Inventor: Paul Chen, Vancouver (CA)

( * ) Notice: Subject to any disclaimer, the term of this patent is extended or adjusted under 35 U.S.C. 154(b) by 49 days.

(21) Appl. No.: 15/381,231

(22) Filed: Dec. 16, 2016

(65) Prior Publication Data

US 2018/0169460 A1 Jun. 21, 2018

(51) Int. Cl.
*A63B 21/00* (2006.01)
*A63B 21/072* (2006.01)
*A63B 21/075* (2006.01)

(52) U.S. Cl.
CPC ..... *A63B 21/075* (2013.01); *A63B 21/00065* (2013.01); *A63B 21/0728* (2013.01); *A63B 21/4035* (2015.10)

(58) Field of Classification Search
CPC ..... A63B 21/072–21/075; A63B 21/00065; A63B 21/4035
See application file for complete search history.

(56) References Cited

U.S. PATENT DOCUMENTS 7,182,715 B2 2/2007 Anderson
7,491,157 B1 * 2/2009 Lin ..... A63B 21/0728 482/107
7,563,208 B1 * 7/2009 Chen ..... A63B 21/0728 482/108
7,731,640 B1 6/2010 Chen
7,811,212 B2 * 10/2010 Chen ..... A63B 21/0728 482/106
7,883,452 B1 2/2011 Chen
7,981,013 B2 * 7/2011 Krull ..... A63B 21/075 482/107
8,012,069 B2 * 9/2011 Towley, III ..... A63B 21/075 482/107
8,784,280 B2 7/2014 Krull
8,858,406 B2 10/2014 Klukas
9,022,906 B1 5/2015 Nelson
9,149,680 B2 10/2015 Thompson et al.
2004/0067826 A1 * 4/2004 Elledge ..... A63B 21/0601 482/106
2009/0062085 A1 * 3/2009 Polevoy ..... A63B 21/0728 482/93
2011/0263392 A1 * 10/2011 Yu ..... A63B 21/072 482/93
2012/0231936 A1 * 9/2012 Krull ..... A63B 21/00065 482/93
2012/0252641 A1 * 10/2012 Odneal ..... A63B 21/072 482/108
2013/0040789 A1 * 2/2013 Kessler ..... A63B 21/072 482/108

(Continued)

*Primary Examiner* — Jennifer M Deichl
(74) *Attorney, Agent, or Firm* — Charles E. Baxley

(57) ABSTRACT

An adjustable kettlebell device includes a kettlebell base having a housing formed below a handle, the housing includes a chamber formed by an upper wall and a bottom wall, one or more weight elements each include a tubular member for engaging into the chamber of the housing, and a latch is slidably received in the housing and movable to engage with the tubular members of the weight elements for detachably attaching the tubular member of the weight elements to the kettlebell base. The tubular member includes a channel formed by a rib, and the latch includes a projection for engaging with the channel of the tubular member of the weight elements.

14 Claims, 15 Drawing Sheets

(56) References Cited

U.S. PATENT DOCUMENTS

| | | | | |
|---|---|---|---|---|
| 2015/0105224 | A1* | 4/2015 | Odneal | A63B 21/0726<br>482/107 |
| 2015/0196792 | A1* | 7/2015 | Towley | A63B 21/075<br>482/93 |
| 2017/0225025 | A1* | 8/2017 | Towley | A63B 21/075 |
| 2017/0259106 | A1* | 9/2017 | Pawlas | A63B 21/4035 |

* cited by examiner

ADJUSTABLE KETTLEBELL DEVICE

BACKGROUND OF THE INVENTION

1. Field of the Invention

The present invention relates to an adjustable kettlebell device, and more particularly to an adjustable kettlebell device including an improved structure for allowing the weight elements to be easily and quickly and adjustably attached to or disengaged from the weight carrier and for allowing the adjustable kettlebell device to be easily operated by the users.

2. Description of the Prior Art

Typical kettlebells comprise a pair of oppositely-facing, generally frustum-shaped weight plates attached to a central plate with a first axis that is perpendicular to the axis of its handle, and the frustum-shaped weight plates may reduce the force of impact against the user's forearm during certain exercise movements.

For example, U.S. Pat. No. 7,182,715 to Anderson discloses one of the typical kettlebell exercise devices comprising a handle attached to a central plate and including places which can be held between the user's thumb and remaining fingers for improved control during other exercise movements.

However, the weight plates may not be easily adjusted and/or changeably attached to the central plate such that the weight of the typical kettlebell may not be changed or adjusted.

U.S. Pat. No. 7,563,208 to Chen, U.S. Pat. No. 7,731,640 to Chen, U.S. Pat. No. 7,811,212 to Chen, U.S. Pat. No. 7,883,452 to Chen, U.S. Pat. No. 8,784,280 to Krull, U.S. Pat. No. 8,858,406 to Klukas, U.S. Pat. No. 9,022,906 to Nelson, and U.S. Pat. No. 9,149,680 to Thompson et al. disclose several other typical adjustable kettlebell device apparatuses each comprising a series of plates in stacked relationship, a handle having a shaft passing through the weight plates and a retaining arrangement including a base engageable with the shaft for holding and securing the weight plates together between the handle and the retaining arrangement.

However, the base should be removed or disengaged from the shaft when engaging the weight plates onto the shaft or when disengaging the weight plates from the shaft, such that it takes time to attach or to disengage the weight plates from the shaft and such that the typical adjustable kettlebell device may not be easily operated by the users.

The present invention has arisen to mitigate and/or obviate the afore-described disadvantages of the conventional adjustable kettlebell devices.

SUMMARY OF THE INVENTION

The primary objective of the present invention is to provide an adjustable kettlebell device or exercise device including an improved structure for allowing the weight elements to be easily and quickly and adjustably attached to or disengaged from the weight carrier and for allowing the adjustable kettlebell device to be easily operated by the users.

In accordance with one aspect of the invention, there is provided an adjustable kettlebell device comprising a kettlebell base including a housing having a handle provided on the housing, the housing including a chamber formed in the housing and defined by an upper wall and a bottom wall, and including an opening formed in the bottom wall and communicating with the chamber of the housing, a first weight element including a tubular member extended therefrom for selectively engaging through the opening of the bottom wall of the housing and into the chamber of the housing, and a latch slidably received in the chamber of the housing and movable to engage with the tubular member for detachably attaching the tubular member of the first weight element to the kettlebell base and for allowing the first weight element to be easily and quickly and adjustably attached to or disengaged from the kettlebell base and for allowing the adjustable kettlebell device to be easily operated by the users.

The tubular member of the first weight element includes a channel formed therein, and the latch includes a projection for selectively engaging with the channel of the tubular member of the first weight element. The tubular member of the first weight element includes a rib for forming or defining the channel of the tubular member, and the latch is selectively engaged with the rib of the tubular member.

The rib of the tubular member of the first weight element is connected to the tubular member with at least one linking member. The tubular member of the first weight element includes a bore formed therein and communicating with the channel of the tubular member, and a second weight element includes a tubular member extended therefrom for selectively engaging through the bore of the tubular member of the first weight element and through the opening of the bottom wall of the housing and into the chamber of the housing.

The tubular member of the second weight element includes a bore formed therein, and a third weight element includes a tubular member extended therefrom for selectively engaging through the bore of the tubular member of the second weight element and through the opening of the bottom wall of the housing and into the chamber of the housing.

The tubular member of the third weight element includes a bore formed therein, and a fourth weight element includes a shaft extended therefrom for selectively engaging through the bore of the tubular member of the third weight element and through the opening of the bottom wall of the housing and into the chamber of the housing. The shaft includes a peripheral depression formed therein for selectively engaging with the projection of the latch, and the shaft includes a head for defining the peripheral depression of the shaft.

The kettlebell base includes an actuating device pivotally attached to the housing and engageable with the latch for selectively actuating and moving the latch toward and away from the tubular member. The actuating device includes a pinion or the like engaged with the latch. The latch includes a rack for engaging with the pinion.

The actuating device includes a knob connected to the pinion. The actuating device includes a catch slidably engaged with the knob, and the knob includes a tongue for engaging with the housing in order to anchor and position the pinion and the latch to the housing at a selected position.

The housing includes a compartment formed therein, and an auxiliary weight element slidably engaged in the compartment of the housing. The housing includes an actuating element for selectively engaging with the auxiliary weight element and for detachably securing the auxiliary weight element to the housing. The auxiliary weight element includes at least one cavity formed therein, and the actuating element includes at least one key extended therefrom for selectively engaging with the cavity of the auxiliary weight element.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
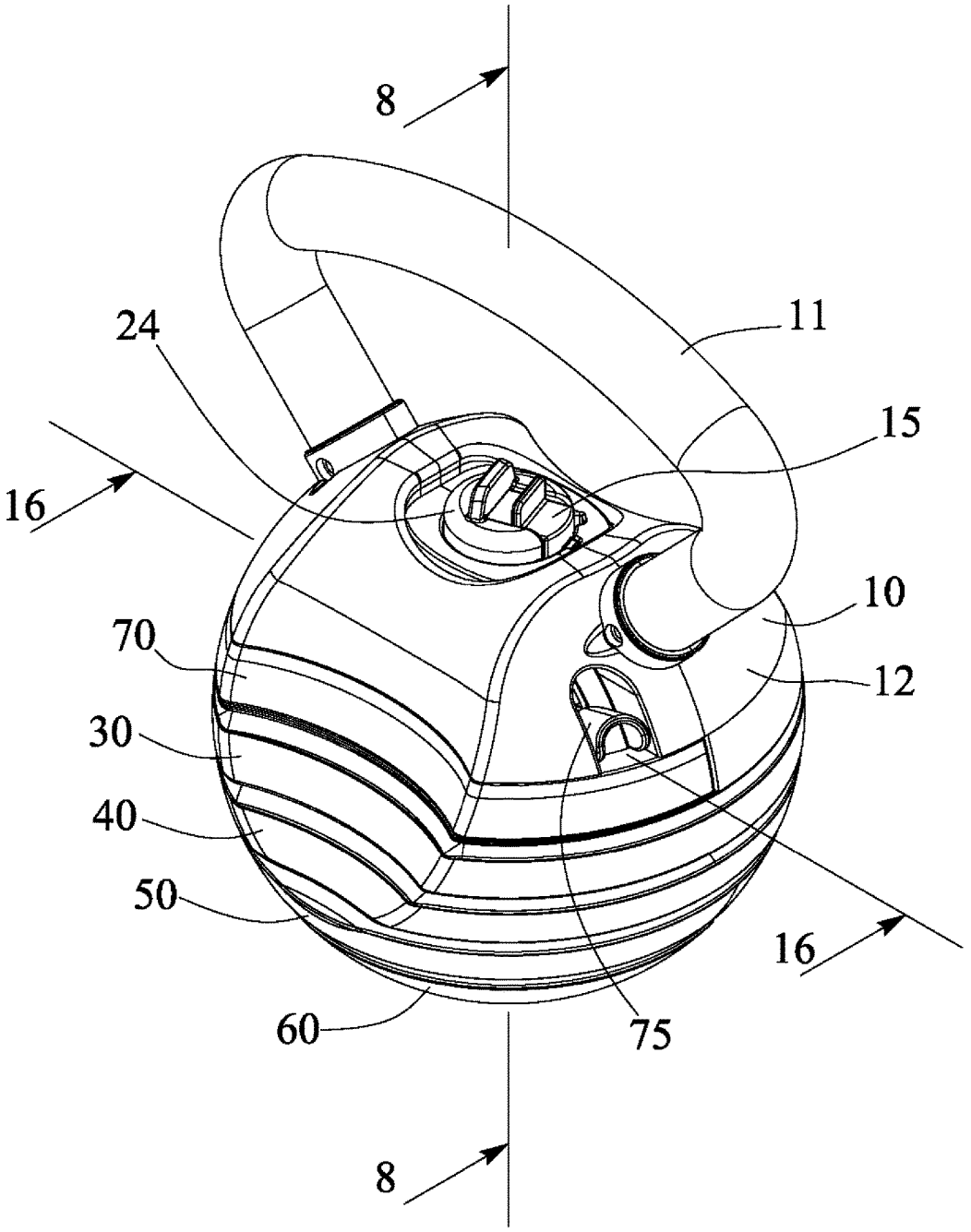
FIG. 1 is a perspective view of an adjustable kettlebell device in accordance with the present invention.
Figure 2:
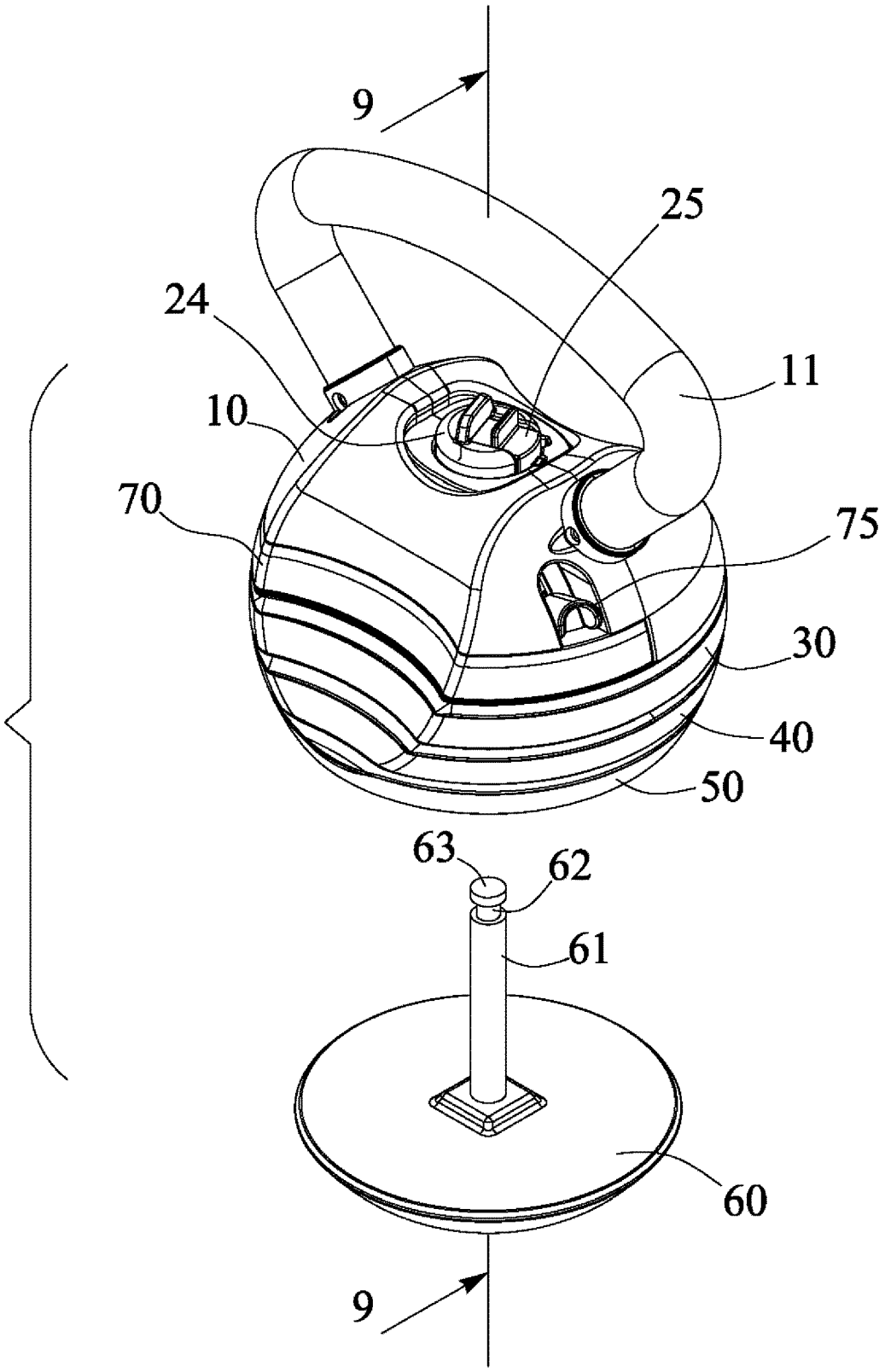
FIGS. 2, 3, 4, 5, 6, 7 are partial exploded views of the adjustable kettlebell device.
Figure 3:
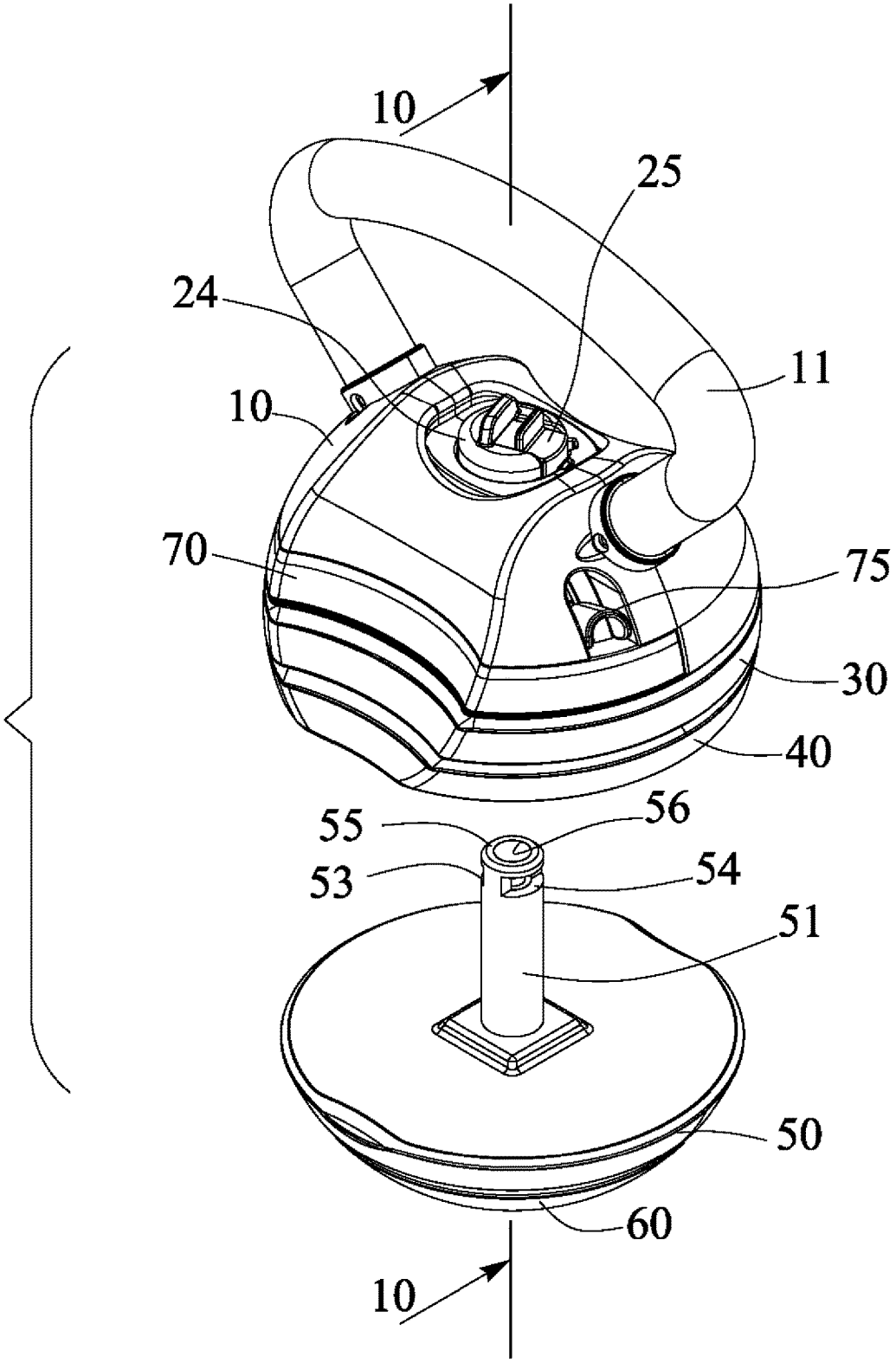
Figure 4:
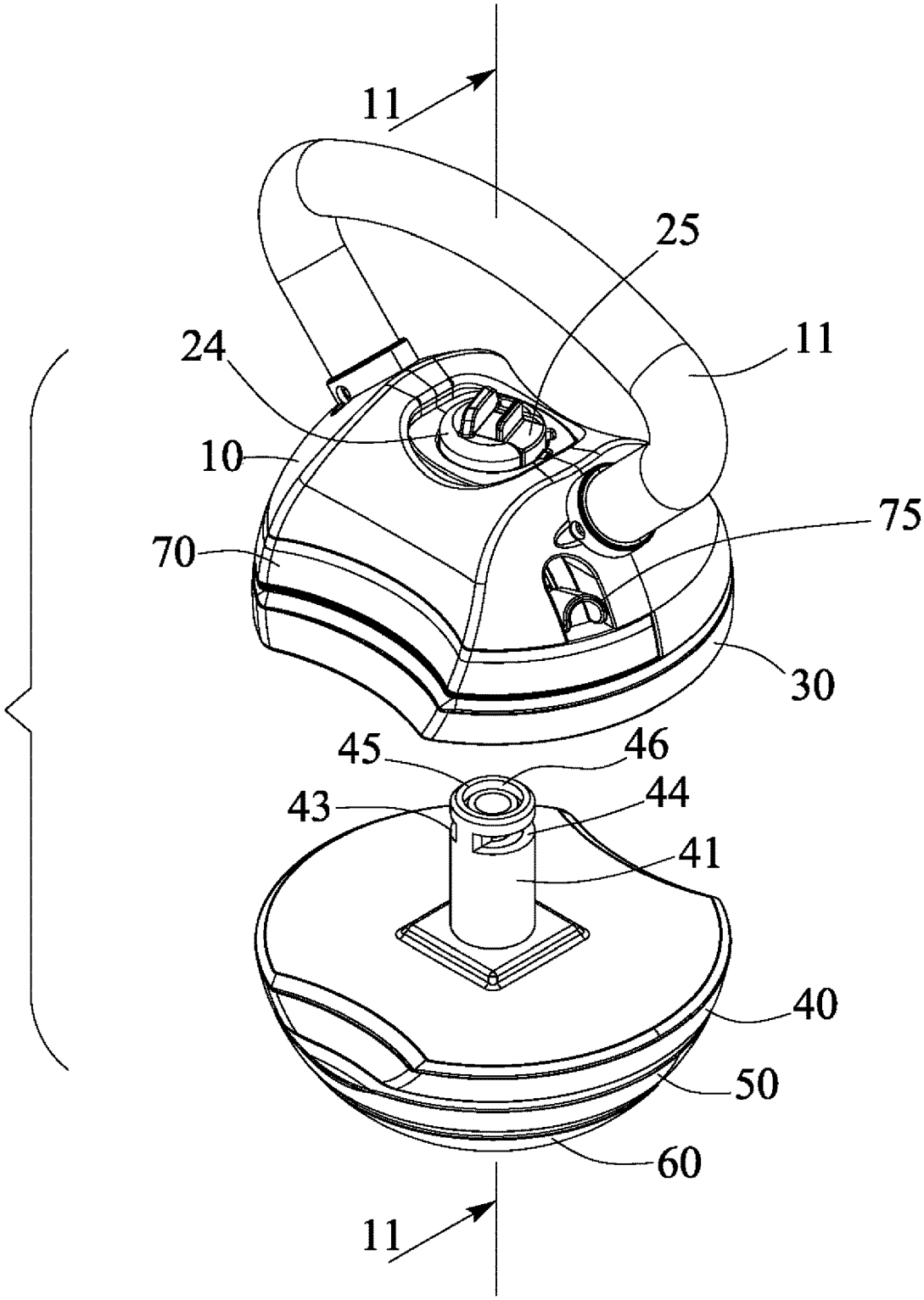
Figure 5:
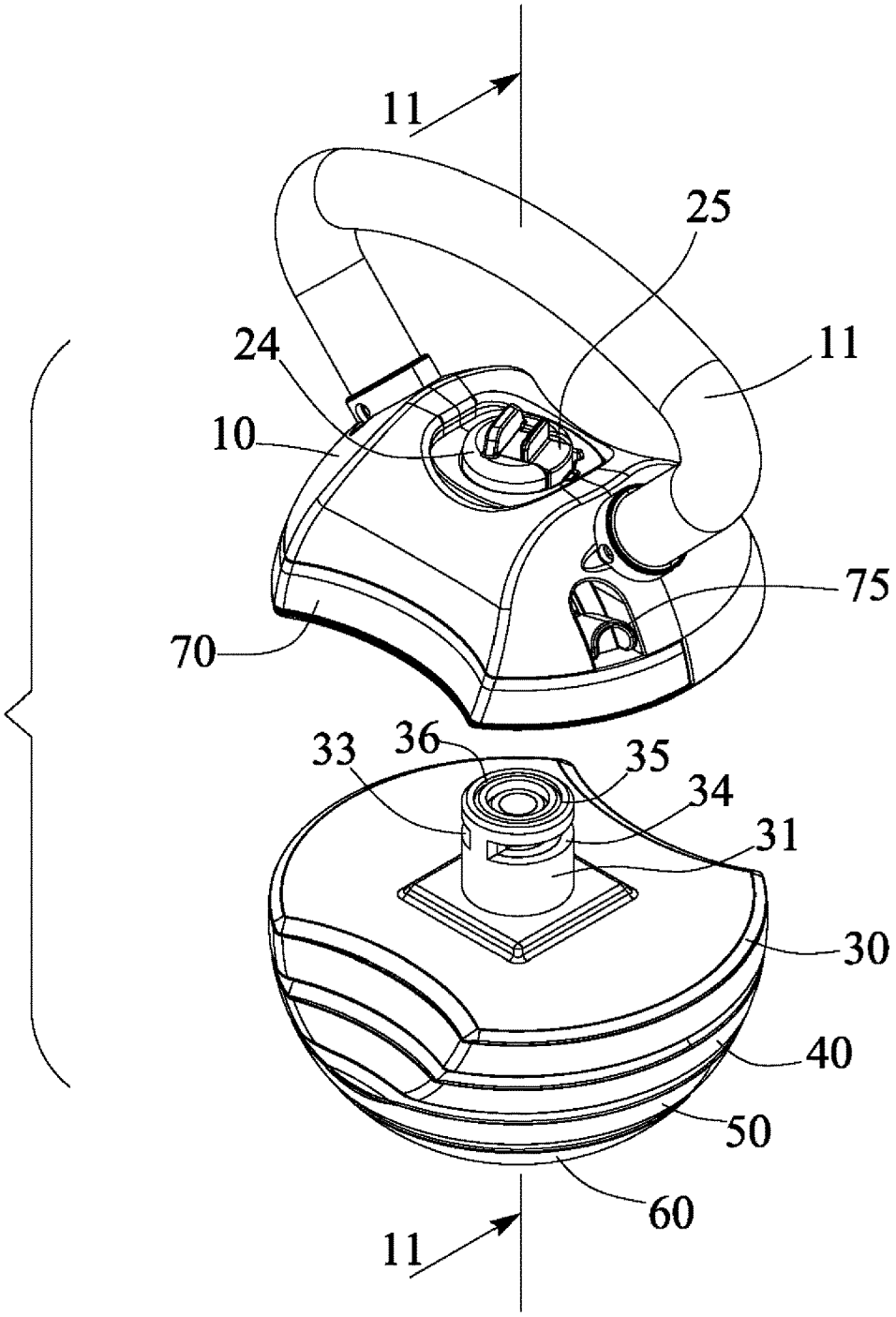
Figure 6:
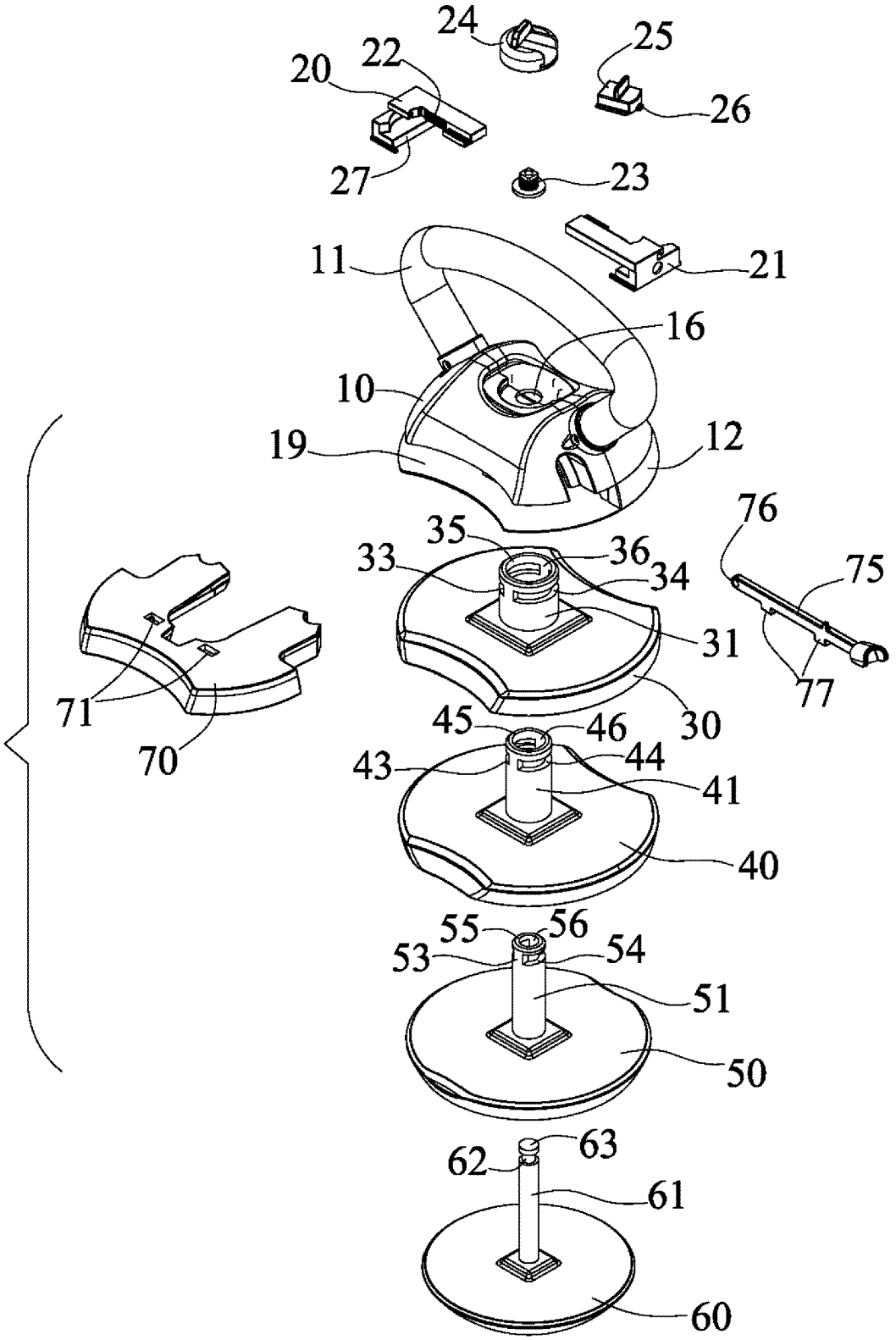
Figure 7:
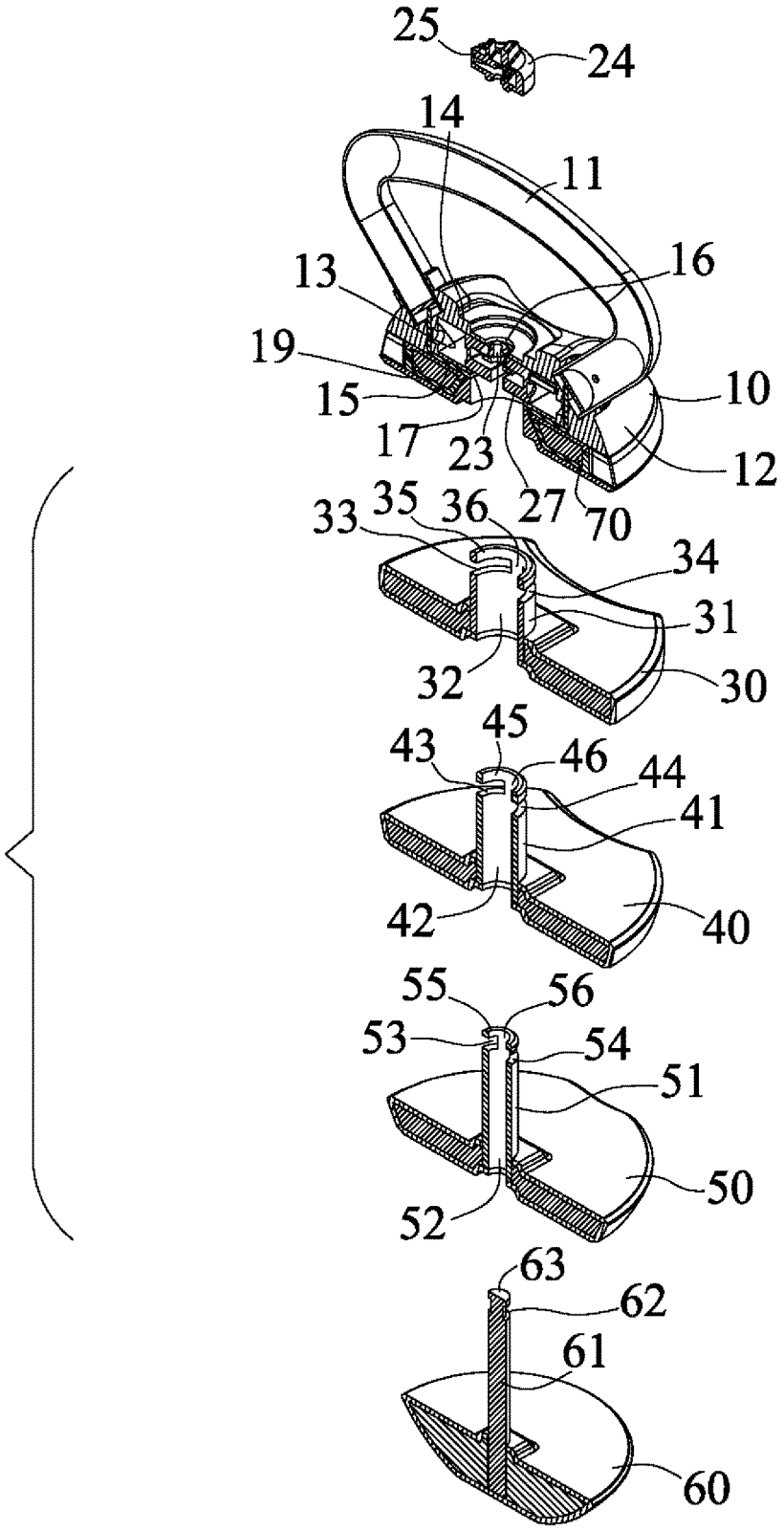
Figure 8:
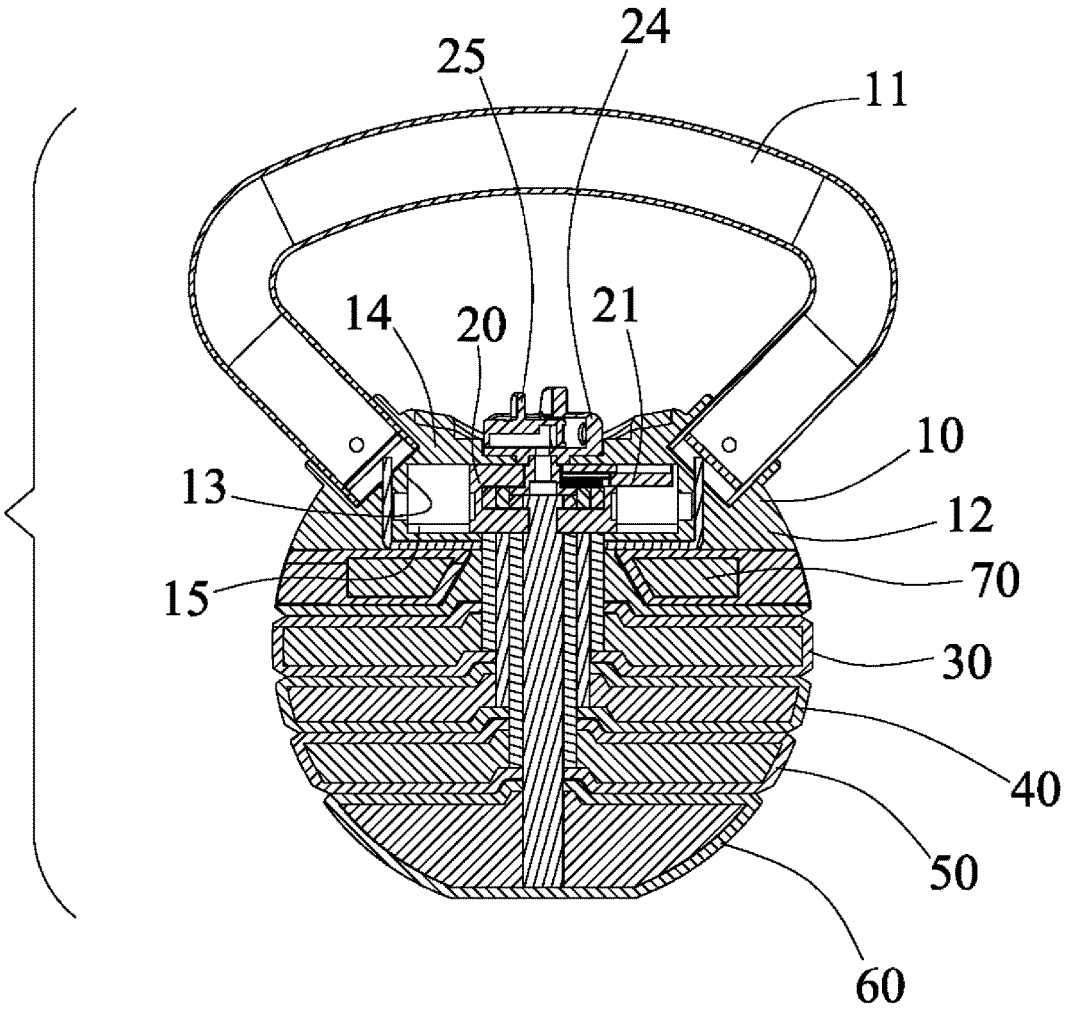
FIGS. 8, 9, 10, 11, 12 are cross sectional views of the adjustable kettlebell device taken along lines 8-8, 9-9, 10-10, 11-11, 12-12 of FIGS. 1-5 respectively, illustrating the operation of the adjustable kettlebell device.

Referring to the drawings, and initially to FIGS. 1-12, an adjustable kettlebell device in accordance with the present invention comprises a housing or kettlebell base 10 including a handle 11 formed or provided on the upper portion of the kettlebell base 10 for being grasped or held by the users and for carrying or lifting or moving the kettlebell base 10 and for allowing the adjustable kettlebell device to be easily operated by the users. The kettlebell base 10 includes a body member or housing 12 formed or provided on the lower or bottom portion thereof, or formed or provided below the handle 11, and includes a compartment or chamber 13 formed in the housing 12 (FIGS. 9-12) and formed or defined by a partition or upper wall 14 and a lower or bottom wall 15, and includes an orifice 16 (FIGS. 6-7) formed in the upper wall 14 and communicating with the chamber 13 of the housing 12, and includes an opening 17 formed in the bottom wall 15 and also communicating with the chamber 13 of the housing 12.

Figure 14:
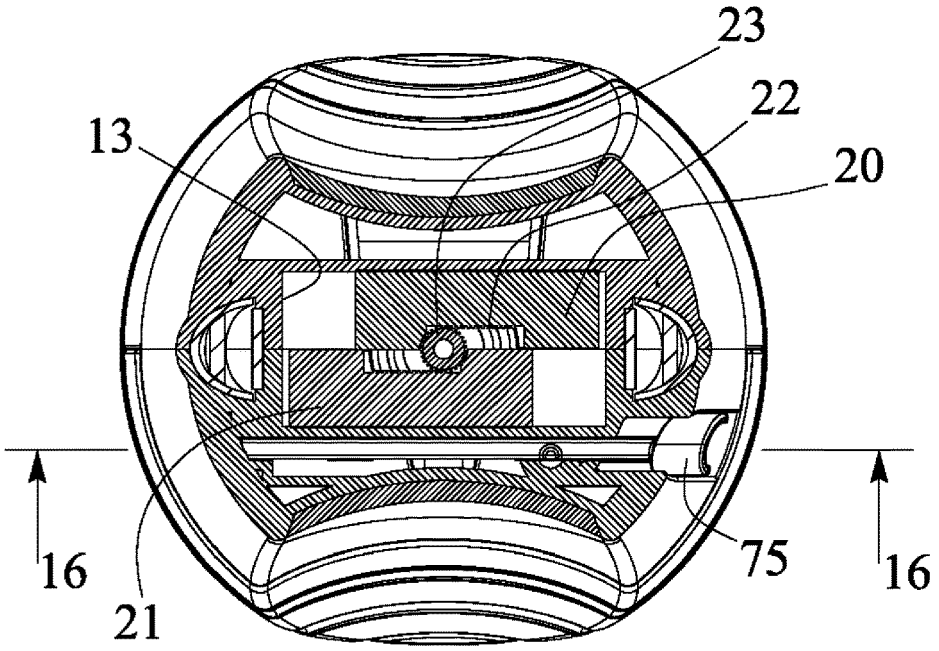
FIGS. 14, 15 are other cross sectional views of the adjustable kettlebell device taken along lines 14-14, and 15-15 of FIG. 13 respectively.
Figure 15:
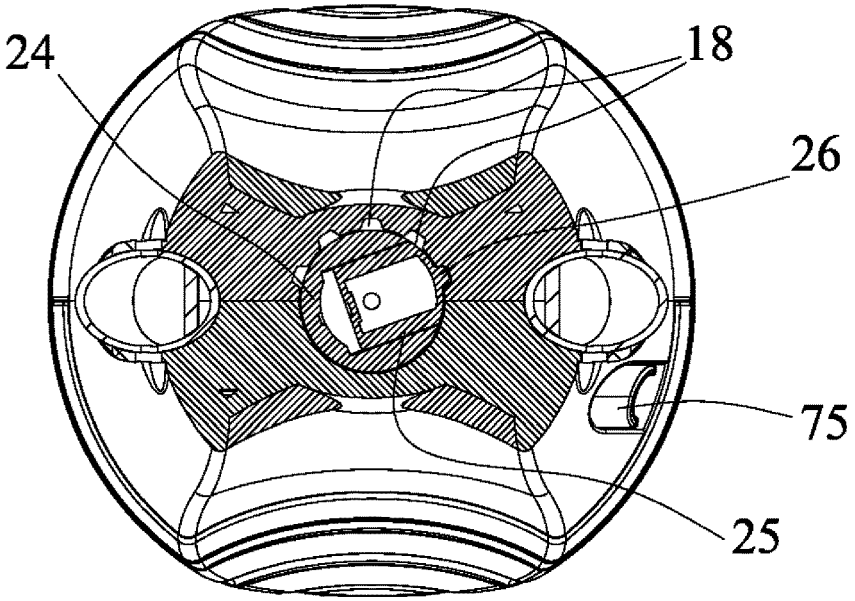
Figure 16:
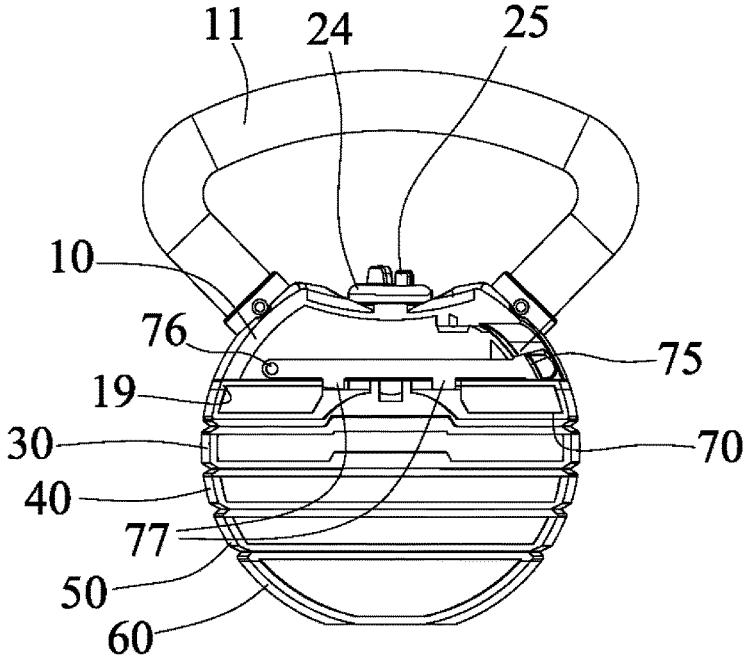
FIG. 16 is a further cross sectional view of the adjustable kettlebell device taken along lines 16-16 of FIG. 14.

It is preferable that the opening 17 of the bottom wall 15 includes a width or inner diameter greater than that of the orifice 16 of the upper wall 14. One or more (such as two) tongues or latches 20, 21 are slidably received or engaged in the chamber 13 of the housing 12 and movable relative to each other and movable relative to the housing 12 and movable toward or away from the orifice 16 of the upper wall 14 and the opening 17 of the bottom wall 15. The latches 20, 21 each include a toothed portion or rack 22 formed or provided thereon (FIGS. 6, 14) for meshing or engaging with an actuating device 23, such as a pinion 23 which is pivotally or rotatably attached to or engaged with the orifice 16 of the upper wall 14 of the housing 12 and which may force or actuate the latches 20, 21 to move toward or away from each other. A knob 24 is attached or secured to the pinion 23 for rotating the pinion or the actuating device 23 relative to the housing 12 and the latches 20, 21, and a catch 25 is slidably engaged with the knob 24 include a tongue 26 for selectively engaging with either of the notches 18 of the housing 12 (FIG. 15) in order to anchor or position or retain the pinion 23 and the latches 20, 21 to the housing 12 at the required or selected position.

Figure 9:
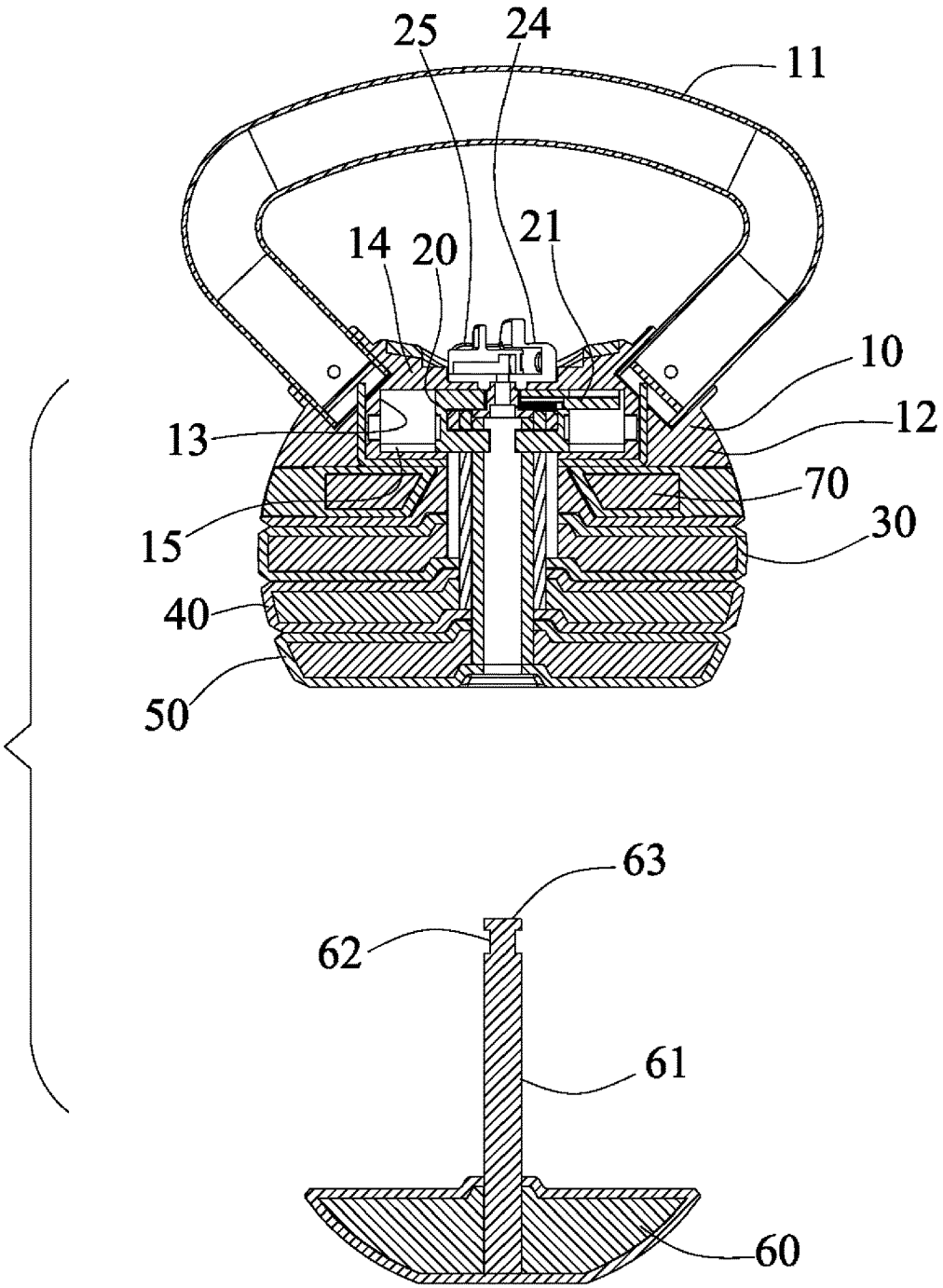
Figure 10:
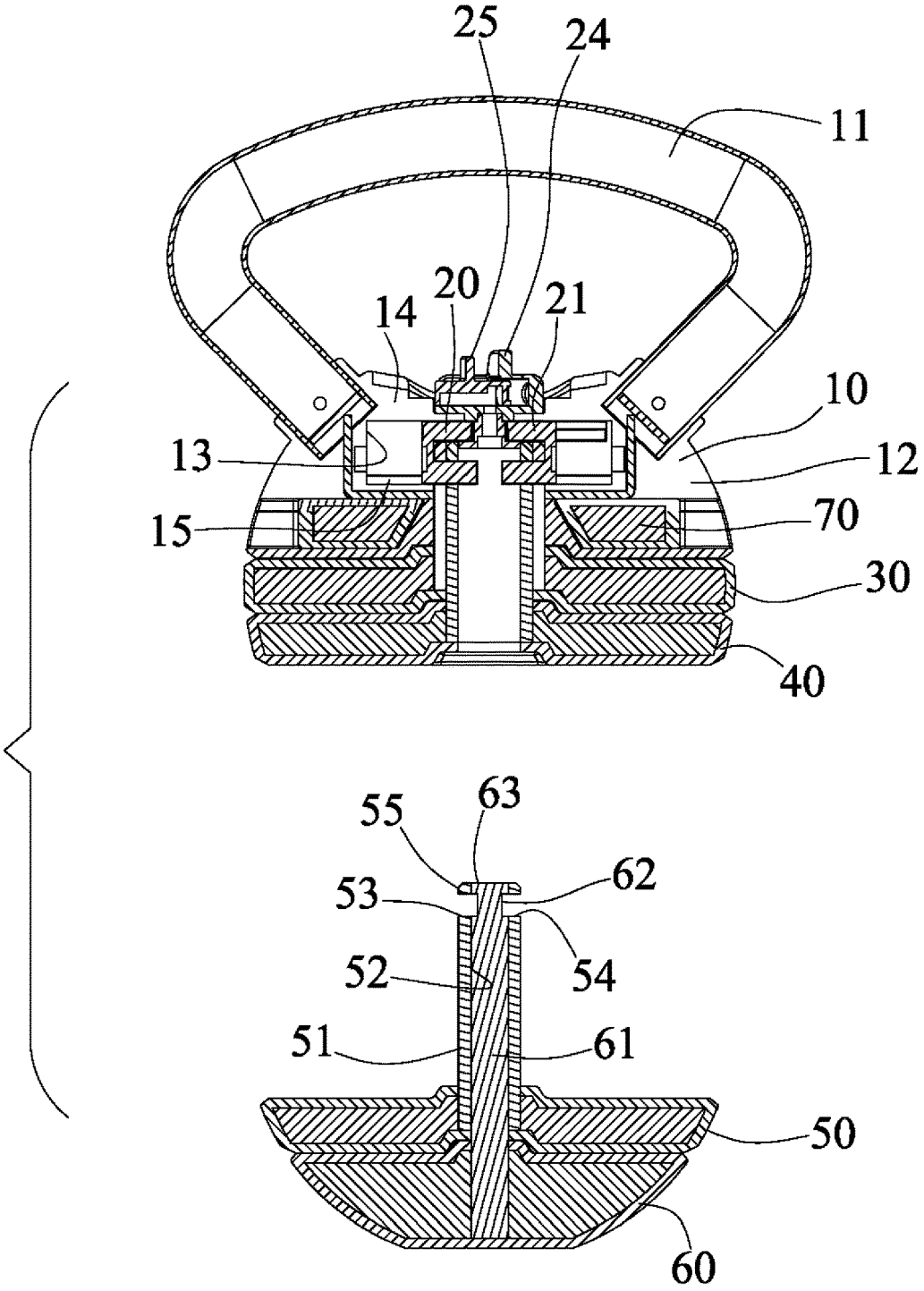
Figure 11:
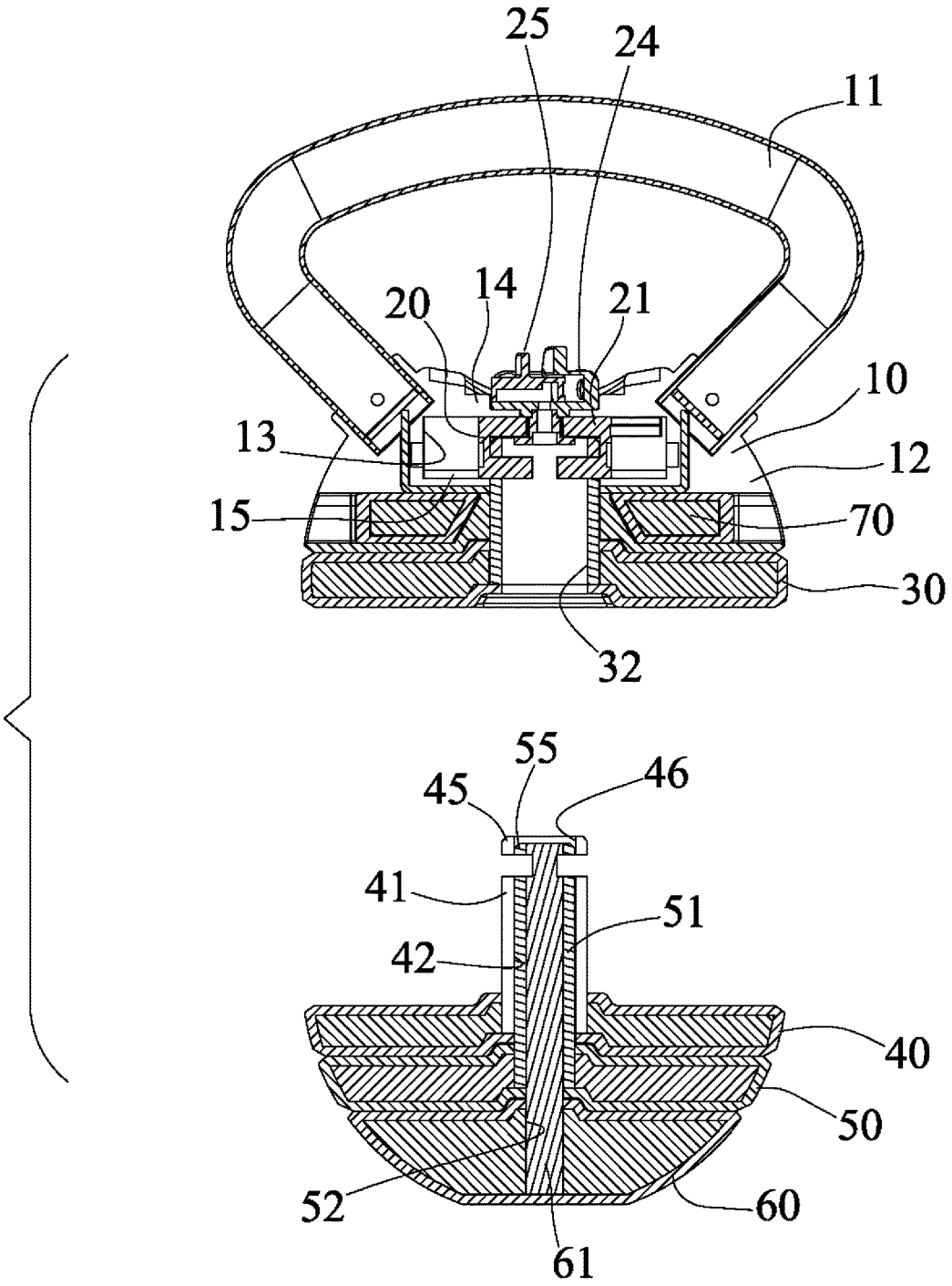
Figure 12:
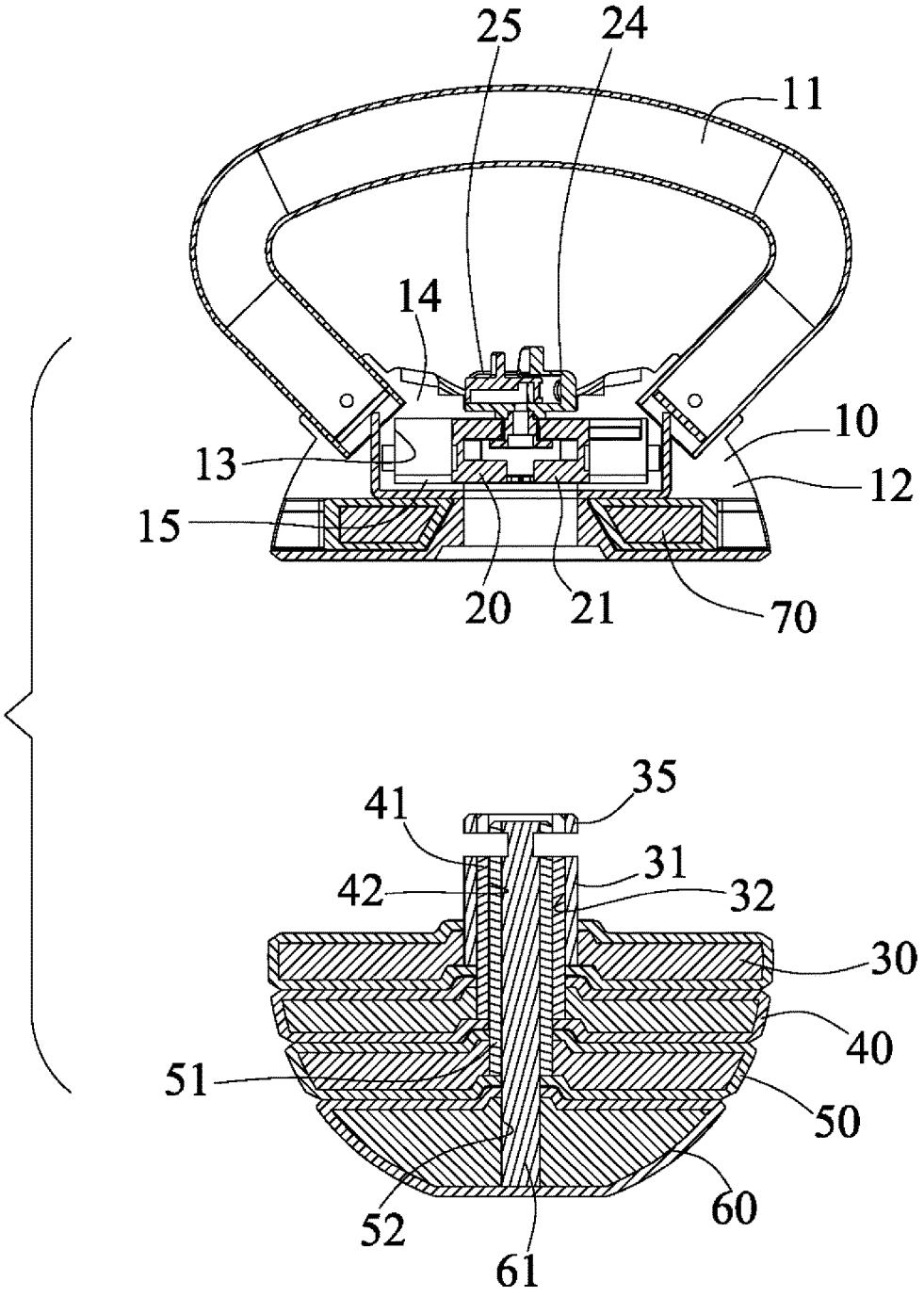
Figure 13:
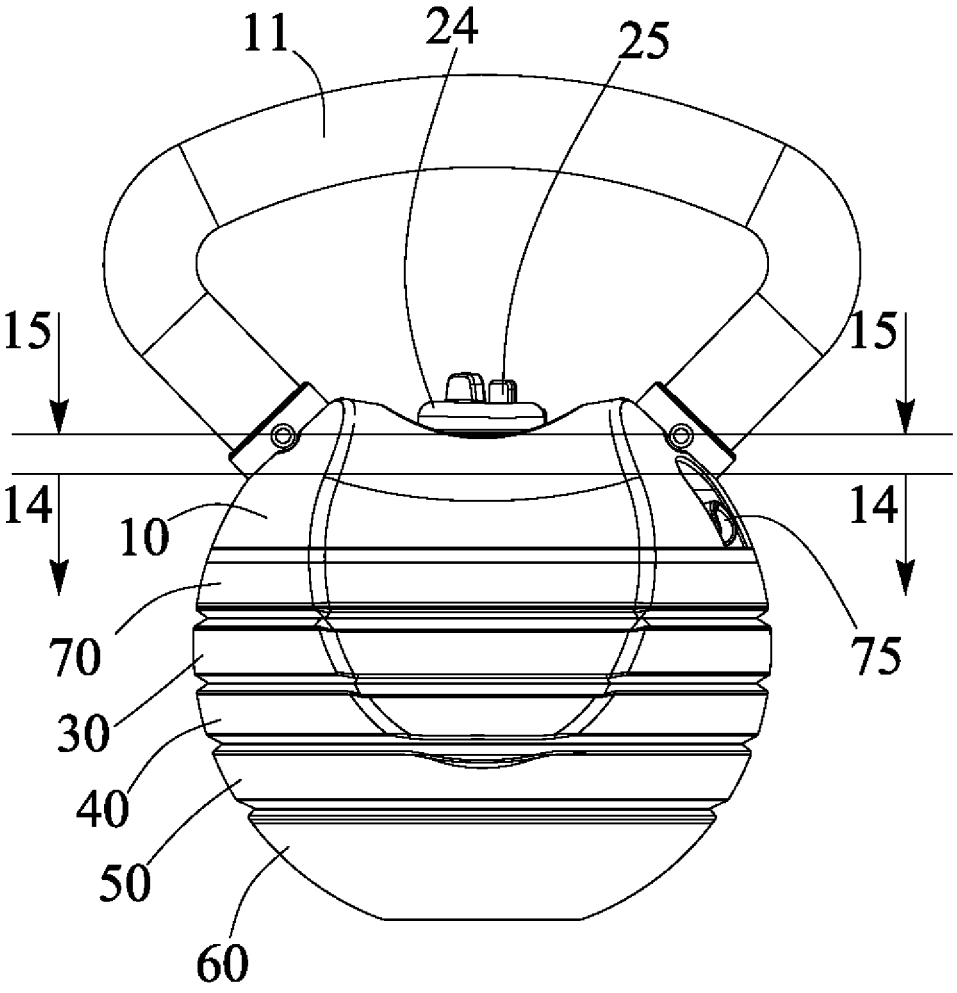
FIG. 13 is a front plan schematic view of the adjustable kettlebell device.

A first weight element 30 includes a barrel or tubular member 31 extended upwardly therefrom for selectively engaging with or into the opening 17 of the bottom wall 15 of the housing 12, and into the chamber 13 of the housing 12 (FIGS. 9-11). The tubular member 31 includes a bore 32 formed therein, and includes one or more (such as two) channels 33, 34 formed therein and communicating with the bore 32 of the tubular member 31 for forming or defining a rib 35 which is connected or coupled to the tubular member 31 with one or more (such as two) linking members 36. The channels 33, 34 and/or the rib 35 of the tubular member 31 may be provided for selectively receiving or engaging with the latches 20, 21, such as the projections 27 of the latches 20, 21 (FIGS. 6-7) for allowing the weight elements 30 to be easily and quickly and detachably attached to or disengaged from the kettlebell base 10 with the latches 20, 21.

A second and one or more third weight elements 40, 50 each include a barrel or tubular member 41, 51 extended upwardly therefrom for selectively engaging with or into the bore 32, 42 of the weight element 30, 40 and through the opening 17 of the bottom wall 15 of the housing 12, and into the chamber 13 of the housing 12 (FIGS. 9-10). The tubular member 41, 51 includes a bore 42, 52 formed therein, and includes one or more (such as two) channels 43, 44; 53, 54 formed therein and communicating with the bore 42, 52 of the tubular member 41, 51 for forming or defining a rib 45, 55 which is connected or coupled to the tubular member 41, 51 with one or more (such as two) linking members 46, 56. The channels 43, 44; 53, 54 and/or the rib 45, 55 of the tubular member 41, 51 may be provided for selectively receiving or engaging with the projections 27 of the latches 20, 21 for allowing the weight elements 40, 50 to be easily and quickly and detachably attached to or disengaged from the kettlebell base 10 with the latches 20, 21.

A fourth or additional weight element 60 includes a vertical or central shaft 61 extended upwardly therefrom for selectively engaging with or into the bore 52 of the tubular member 51 and includes an inner peripheral depression 62 formed therein and defined by a head 63 for selectively engaging with the projections 27 of the latches 20, 21 (FIG. 8) and for allowing the weight elements 30, 40, 50, 60 to be easily and quickly attached to or disengaged from the kettlebell base 10 with the latches 20, 21. The inner peripheral depression 62 of the shaft 61 of the additional weight element 60 may be selectively aligned with the channels 43, 44; 53, 54 of the tubular member 41, 51.

In operation, as shown in FIGS. 1-12, the tubular member 31 of the first weight element 30 may be received or engaged in the opening 17 of the bottom wall 15 of the housing 12, and into the chamber 13 of the housing 12, the tubular member 41 of the second weight element 40 may be received or engaged in the bore 32 of the first weight element 30 and through the opening 17 of the bottom wall 15 of the housing 12, and into the chamber 13 of the housing 12, the tubular member 51 of the third weight element 50 may also be received or engaged in the bore 42 of the second weight element 40 and through the opening 17 of the bottom wall 15 of the housing 12, and into the chamber 13 of the housing 12, and the shaft 61 of the additional weight element 60 may also be selectively engaged in the bore 52 of the third weight element 50 and through the opening 17 of the bottom wall 15 of the housing 12, and into the chamber 13 of the housing 12 (FIGS. 8-12).

The latches 20, 21 may then be selectively actuated or moved away from each other with the pinion 23 and/or the knob 24 (FIG. 14) for allowing the projections 27 of the latches 20, 21 to be forced to move and to engage with the channels 33, 34; 43, 44; 53, 54 and/or the inner peripheral depression 62 of the shaft 61 of the additional weight element 60, and/or the rib 35, 45, 55 of the tubular member 31, 41, 51, in order to anchor or position or retain or secure the tubular member 31, 41, 51 and/or the shaft 61 of the weight elements 30, 40, 50, 60 to the kettlebell base 10.

Figure 17:
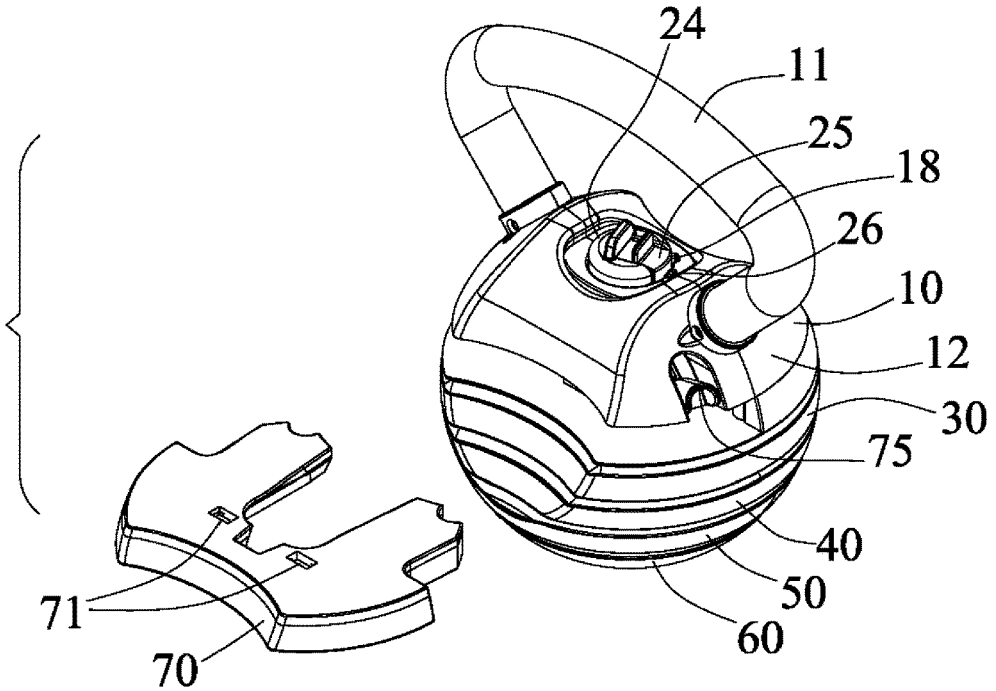
FIG. 17 is a further partial exploded view of the adjustable kettlebell device.

It is preferable that the housing 12 of the kettlebell base 10 further includes a chamber or compartment 19 formed therein (FIGS. 6-7, 16-17) for slidably receiving or engaging with an additional or auxiliary weight element 70 which includes one or more (such as two) cavities 71 formed therein (FIGS. 6, 17), and another actuating device or element 75 is pivotally or rotatably attached to or engaged in the housing 12 of the kettlebell base 10 with a pivot pin 76, and includes one or more (such as two) projections or keys 77 extended therefrom for selectively engaging with the cavities 71 of the additional or auxiliary weight element 70 and for detachably attaching or mounting or securing the additional or auxiliary weight element 70 to the housing 12 of the kettlebell base 10 with the actuating element 75, and for allowing the adjustable kettlebell device to be easily adjusted to different weights.

Accordingly, the adjustable kettlebell device in accordance with the present invention includes an improved structure for allowing the weight elements to be easily and adjustably attached to or disengaged from the weight carrier and for allowing the adjustable kettlebell device to be easily actuated or operated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable kettlebell device comprising:

a kettlebell base including a housing having a handle provided on said housing, said housing including a chamber formed in said housing and defined by an upper wall and a bottom wall, and including an opening formed in said bottom wall and communicating with said chamber of said housing, a first weight element including a tubular member extended therefrom for selectively engaging through said opening of said bottom wall of said housing and into said chamber of said housing, said tubular member of said first weight element including a channel formed therein, said tubular member of said first weight element including a rib for forming said channel of said tubular member, and a latch slidably received in said chamber of said housing and movable to engage with said tubular member for detachably attaching said tubular member of said first weight element to said kettlebell base, said latch including a projection for selectively engaging with said channel of said tubular member of said first weight element, and said latch being selectively engaged with said rib of said tubular member.

2. The adjustable kettlebell device as claimed in claim 1, wherein said rib of said tubular member of said first weight element is connected to said tubular member with at least one linking member.

3. The adjustable kettlebell device as claimed in claim 1, wherein said tubular member of said first weight element includes a bore formed therein and communicating with said channel of said tubular member, and a second weight element includes a tubular member extended therefrom for selectively engaging through said bore of said tubular member of said first weight element and through said opening of said bottom wall of said housing and into said chamber of said housing.

4. The adjustable kettlebell device as claimed in claim 3, wherein said tubular member of said second weight element includes a bore formed therein, and a third weight element includes a tubular member extended therefrom for selectively engaging through said bore of said tubular member of said second weight element and through said opening of said bottom wall of said housing and into said chamber of said housing.

5. The adjustable kettlebell device as claimed in claim 4, wherein said tubular member of said third weight element includes a bore formed therein, and a fourth weight element includes a shaft extended therefrom for selectively engaging through said bore of said tubular member of said third weight element and through said opening of said bottom wall of said housing and into said chamber of said housing.

6. The adjustable kettlebell device as claimed in claim 5, wherein said shaft includes a peripheral depression formed therein for selectively engaging with said projection of said latch, and said shaft includes a head for defining said peripheral depression of said shaft.

7. The adjustable kettlebell device as claimed in claim 1, wherein said kettlebell base includes an actuating device pivotally attached to said housing and engageable with said latch for selectively actuating and moving said latch toward and away from said tubular member.

8. The adjustable kettlebell device as claimed in claim 1, wherein said housing includes a compartment formed therein, and an auxiliary weight element slidably engaged in said compartment of said housing.

9. The adjustable kettlebell device as claimed in claim 8, wherein said housing includes an actuating element for selectively engaging with said auxiliary weight element and for detachably securing said auxiliary weight element to said housing.

10. The adjustable kettlebell device as claimed in claim 9, wherein said auxiliary weight element includes at least one cavity formed therein, and said actuating element includes at least one key extended therefrom for selectively engaging with said at least one cavity of said auxiliary weight element.

11. An adjustable kettlebell device comprising:

a kettlebell base including a housing having a handle provided on said housing, said housing including a chamber formed in said housing and defined by an upper wall and a bottom wall, and including an opening formed in said bottom wall and communicating with said chamber of said housing, a first weight element including a tubular member extended therefrom for selectively engaging through said opening of said bottom wall of said housing and into said chamber of said housing, and a latch slidably received in said chamber of said housing and movable to engage with said tubular member for detachably attaching said tubular member of said first weight element to said kettlebell base, said kettlebell base including an actuating device pivotally attached to said housing and engageable with said latch for selectively actuating and moving said latch toward and away from said tubular member, wherein said actuating device includes a pinion engaged with said latch.

12. The adjustable kettlebell device as claimed in claim 11, wherein said latch includes a rack for engaging with said pinion.

13. The adjustable kettlebell device as claimed in claim 11, wherein said actuating device includes a knob connected to said pinion.

14. The adjustable kettlebell device as claimed in claim 13, wherein said actuating device includes a catch slidably engaged with said knob, and said knob includes a tongue for engaging with said housing in order to anchor and position said pinion and said latch to said housing at a selected position.

* * * * *